US011459987B2

(12) United States Patent
Nelson et al.

(10) Patent No.: US 11,459,987 B2
(45) Date of Patent: Oct. 4, 2022

(54) VALVE ASSEMBLY HAVING ELECTRICAL ACTUATOR WITH BALANCED STATOR

(71) Applicant: Caterpillar Inc., Peoria, IL (US)

(72) Inventors: Bryan E. Nelson, Chillicothe, IL (US); Nikhil M. Arya, Washington, IL (US); Andrew J. Menssen, Bloomington, IL (US)

(73) Assignee: Caterpillar Inc., Peoria, IL (US)

( * ) Notice: Subject to any disclaimer, the term of this patent is extended or adjusted under 35 U.S.C. 154(b) by 135 days.

(21) Appl. No.: 16/992,487

(22) Filed: Aug. 13, 2020

(65) Prior Publication Data

US 2022/0049673 A1 Feb. 17, 2022

(51) Int. Cl.

| | |
|---|---|
| ***F02M 47/02*** | (2006.01) |
| ***H01F 7/08*** | (2006.01) |
| ***F02M 63/00*** | (2006.01) |

(52) U.S. Cl.

CPC ..... *F02M 47/027* (2013.01); *F02M 63/0021* (2013.01); *H01F 7/081* (2013.01); *F02M 2200/04* (2013.01)

(58) Field of Classification Search

CPC ..... F02M 47/027; F02M 63/0021; F02M 2200/04; H01F 7/081

USPC ..... 123/472

See application file for complete search history.

(56) References Cited

U.S. PATENT DOCUMENTS

| | | | | |
|---|---|---|---|---|
| 5,155,461 | A * | 10/1992 | Teerman | H01F 41/02 335/278 |
| 5,339,063 | A * | 8/1994 | Pham | F02M 59/466 335/278 |
| 5,782,411 | A * | 7/1998 | Potter | F02M 59/466 239/585.1 |
| 7,766,303 | B2 * | 8/2010 | Kaneko | F02M 63/0015 335/287 |
| 7,866,301 | B2 | 1/2011 | Venkataraghavan | |
| 10,711,754 | B2 * | 7/2020 | Nelson | F02M 51/0642 |
| 2016/0258401 | A1 * | 9/2016 | Kim | F02M 63/0064 |

FOREIGN PATENT DOCUMENTS

| | | |
|---|---|---|
| EP | 2409308 A | 1/2012 |

* cited by examiner

*Primary Examiner* — Mahmoud Gimie

(57) ABSTRACT

A valve assembly for a pump includes an electrical actuator having a stator and an armature. The stator includes an annular outer stator portion and an annular inner stator portion, and an annular channel formed radially between the outer stator portion and the inner stator portion. A first radial channel extending through the annular outer stator portion between an outer surface of the outer stator portion and the annular channel, and at least one second opening in the annular outer stator portion results in magnetic symmetry of the stator. Upon activating the electrical actuator, the attraction of the armature towards the stator is uniform thus displacing fluid between the stator and armature in a uniform manner and to avoid high velocity, potentially damaging fluid flow.

19 Claims, 6 Drawing Sheets

VALVE ASSEMBLY HAVING ELECTRICAL ACTUATOR WITH BALANCED STATOR

TECHNICAL FIELD

The present disclosure relates generally to stator design and operation in electrical actuators, and more particularly to a valve assembly having an electrical actuator stator shaped to limit high velocity flows of fluid displaced as a result of movement of the armature in the valve assembly.

BACKGROUND

A great many different pump designs are used for transferring and pressurizing fluids. In the context of fuel systems, such as for internal combustion engines, electronically-controlled, high-pressure fuel pumps are commonplace and used to pressurize a fuel such as diesel fuel for injection into an engine cylinder. Highly pressurized fuel injection strategies have been shown to be effective for reduced emissions operation. In one design, a high pressure fuel pump feeds a so-called common rail that provides a fluid reservoir storing a quantity of pressurized fuel for delivery to a plurality of fuel injectors. In other designs, fuel pumps are associated individually with fuel injectors, and are known as unit pumps.

To achieve a high level of control of moving parts within such pumps, electrical actuators such as solenoid actuators are used to control valve positioning and fluid connections. Solenoids produce a magnetic field when electrical current is applied that can generate local forces with sufficient energy to actuate components within the fuel system hardware. Engineers have experimented with a wide variety of different electrical actuator and pump designs over the years. With the drive toward ever-increasing pressure and control over fuel injection amount, fuel injection rate and other properties, the electrical actuators and associated valve components within fuel pumps tend to move relatively rapidly and can impact valve seats, stops, or other surfaces with relatively high forces. One example fuel pump design is known from U.S. Pat. No. 5,743,238 to Shorey et al. In the configuration shown in Shorey et al., an electrical actuator is used to control a valve that apparently varies position to alternately allow or inhibit fuel flow to a pumping chamber.

SUMMARY OF THE INVENTION

In one aspect, a valve assembly includes a valve member operatively associated with a valve seat, with the valve member being movable along a valve central axis between a first open position at which the valve member is spaced from the valve seat and a second closed position at which the valve member engages the valve seat to seal an opening of the valve assembly. An electrical actuator includes a stator and an armature coupled to the valve member. The stator includes an annular outer stator portion and an annular inner stator portion, and an annular channel formed radially between the outer stator portion and the inner stator portion. A first radial channel extends through the annular outer stator portion between an outer surface of the outer stator portion and the annular channel. At least one second opening is disposed in the annular outer stator portion on an opposite half of the stator from the first radial channel. The stator is magnetically symmetrical along a line bisecting the first radial channel and perpendicular to the central axis. A winding and terminal assembly includes an electrically conductive winding disposed within the annular channel and between the outer stator portion and the inner stator portion and electrically conductive terminals electrically connected to the winding. A portion of the winding and terminal assembly extends through the first radial. The armature includes an armature plate defining an armature center axis, with the armature center axis being co-linear with the valve central axis and being movable between a rest position and an activated position to vary a position of the valve member, in response to a change to an energy state of the electrical actuator. The armature plate includes a top armature surface facing the stator.

In another aspect, a valve assembly includes a valve member operatively associated with a valve seat, with the valve member being movable along a valve central axis between a first open position at which the valve member is spaced from the valve seat and a second closed position at which the valve member engages the valve seat to seal an opening of the valve assembly. An electrical actuator includes a stator and an armature coupled to the valve member. The stator includes an annular outer stator portion and an annular inner stator portion, and an annular channel formed radially between the outer stator portion and the inner stator portion. A first radial channel extends through the annular outer stator portion between an outer surface of the outer stator portion and the annular channel. At least one second opening is disposed in the annular outer stator portion on an opposite half of the stator from the first radial channel. The stator is magnetically symmetrical along a line bisecting the first radial channel and perpendicular to the central axis. A winding and terminal assembly includes an electrically conductive winding disposed within the annular channel and between the outer stator portion and the inner stator portion and electrically conductive terminals electrically connected to the winding. A portion of the winding and terminal assembly extends through the first radial channel. An insert-molded body extends about the stator and into each of the first radial channel and the at least one second opening. The armature includes an armature plate defining an armature center axis, with the armature center axis being co-linear with the valve central axis and being movable between a rest position and an activated position to vary a position of the valve member, in response to a change to an energy state of the electrical actuator. The armature plate includes a top armature surface facing the stator.

In still another aspect, a pump includes a pump housing, and a pumping element movable between a retracted position and an advanced position within a pumping chamber formed in the pump housing. The pump further includes a valve assembly for controlling a flow of a fluid to or from the pumping chamber. The valve assembly includes a valve member operatively associated with a valve seat, with the valve member being movable along a valve central axis between a first open position at which the valve member is spaced from the valve seat and a second closed position at which the valve member engages the valve seat to seal an opening of the valve assembly. An electrical actuator includes a stator and an armature coupled to the valve member. The stator includes an annular outer stator portion and an annular inner stator portion, and an annular channel formed radially between the outer stator portion and the inner stator portion. A first radial channel extends through the annular outer stator portion between an outer surface of the outer stator portion and the annular channel. At least one second opening is disposed in the annular outer stator portion on an opposite half of the stator from the first radial channel. The stator is magnetically symmetrical along a line bisecting the first radial channel and perpendicular to the central axis. A winding and terminal assembly includes an electrically conductive winding disposed within the annular channel and between the outer stator portion and the inner stator portion and electrically conductive terminals electrically connected to the winding. A portion of the winding and terminal assembly extends through the first radial channel. The armature includes an armature plate defining an armature center axis, with the armature center axis being colinear with the valve central axis and being movable between a rest position and an activated position to vary a position of the valve member, in response to a change to an energy state of the electrical actuator. The armature plate includes a top armature surface facing the stator.

DETAILED DESCRIPTION

Figure 1:
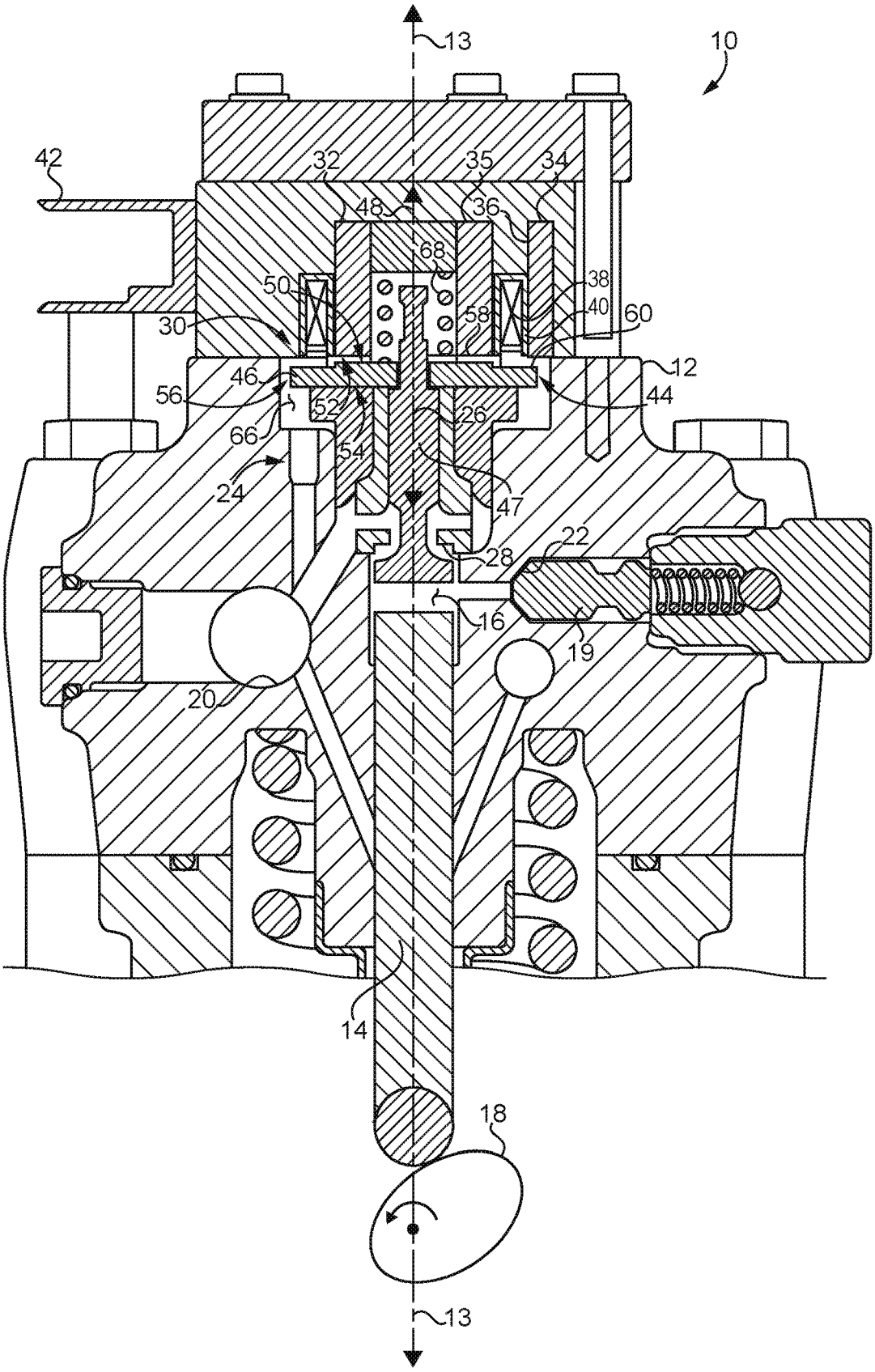
FIG. 1 is a sectioned side diagrammatic view of a pump, according to one embodiment.

Referring to FIG. 1, there is shown a pump 10 according to one embodiment and including a pump housing 12 defining a pump housing longitudinal axis 13. A pumping element in the nature of a plunger 14 is positioned within pump housing 12 and movable between an advanced position and a retracted position within a pumping chamber or plunger cavity 16. Plunger 14 is movable between the advanced position and the retracted position in response to rotation of a cam 18 in the illustrated embodiment. Pump 10 could be a fuel pump used, for example, to pressurize a fuel such as a diesel fuel for delivery to a common rail (not shown) that supplies pressurized fuel to a plurality of fuel injectors in an internal combustion engine. Pump 10 could alternatively be a so-called unit pump associated with a single fuel injector. In still other embodiments pump 10 might not be a fuel pump at all.

Plunger 14 is the only plunger visible in the section plane of FIG. 1, however, those skilled in the art will appreciate that one or more additional plungers will typically be part of pump 10 and reciprocate, in-phase or out of phase, in response to engine cam rotation in a generally known manner. Plunger 14 can pressurize fuel within plunger cavity 16, and transition the fuel between a pump inlet 20 and a pump outlet 22. A valve member 26 of a valve assembly 24 is also positioned within pump housing 12 and movable between a rest position at which a valve seat 28 is open and pump inlet 20 is in fluid communication with plunger cavity 16, and an activated position at which valve member 26 blocks valve seat 28 and pump inlet 20 is blocked from fluid communication with plunger cavity 16. Valve member 26 could be positioned to block valve seat 28 during a pressurization stroke of plunger 14.

A spring-biased outlet valve 19 blocks pump outlet 22, but opens in response to sufficient pressure to enable fluid communication between plunger cavity 16 and a common rail or other component to be supplied with pressurized fuel. Other valve positioning and operating strategies could be used. Valve member 26 could include a control valve that controls the position of another valve, for example. Valve assembly 24 also includes an electrical actuator 30, the operation and unique configuration of which is further discussed herein.

Electrical actuator 30 includes a stator 32 positioned within or coupled with pump housing 12, and an armature 44. Armature 44 may be coupled to valve member 26, and in an implementation can include an armature pin 47 that is attached to and/or formed integrally with valve member 26. Valve member 26 and/or armature pin 47 extends through armature plate 46. Armature 44 and armature plate 46 are terms used interchangeably herein. Changing an energy state of electrical actuator 30 can cause armature 44 to move according to well-known principles relative to stator 32. A change to the energy state will typically include electrically energizing electrical actuator 30, however, embodiments are contemplated in which a change to the energy state includes deenergizing electrical actuator 30. Increasing an energy state of electrical actuator 30 from a first energy state to a higher energy state, or decreasing an energy state from a higher energy state to a lower energy state, could also be understood as changing an energy state as contemplated herein.

In the illustrated embodiment, stator 32 includes an outer stator portion 34 having an annular shape, and an inner stator portion 35 also having an annular shape. Outer stator portion 34 and inner stator portion 35 can be concentrically arranged with one another, and centered on pump housing longitudinal axis 13, however, the present disclosure is not thereby limited. An annular channel 36 is formed between outer stator portion 34 and inner stator portion 35. In the illustrated embodiment, electrical actuator 30 includes a solenoid electrical actuator having a winding 38 that is positioned within or at least partially within channel 36. Winding 38 includes electrically conductive metallic material in a generally conventional manner. Electrical actuator 30 may also include a non-metallic over-molding 40 encasing winding 38. An electrical plug 42 is coupled with pump housing 12 to provide for electrical connections with winding 38.

Stator 32 also includes a stator end face 52 ("stator face 52") that faces armature 44 and is formed in part by annular end faces (not numbered) of each of outer stator portion 34 and inner stator portion 35 that are positioned in a common plane, and also in part, in embodiments, by winding 38. Over-molding 40 thus forms an exposed portion of stator face 52, the significance of which will be apparent from the following description.

Armature plate 46 defines armature center axis 48. At the state depicted in FIG. 1, armature center axis 48 is substantially collinear with pump housing longitudinal axis 13. Armature 44, including armature plate 46, is further movable between a rest position, corresponding to the rest position of valve member 26, and an activated position corresponding to an activated position of valve member 26. At the rest position of armature 44, armature plate 46 is spaced from stator 32. At the activated position of armature 44, armature plate 46 is adjacent to stator 32, with travel of armature 44 and valve member 26 typically stopped by contact of valve member 26 with valve seat 28. As noted above, armature 44 and valve member 26 are movable together in the described manner in response to a change to an energy state of electrical actuator 30. A return spring 68 may be provided for returning armature 44 and valve member 26 to the rest position once electrical actuator 30 is deenergized or otherwise suitably varied in energy state.

Figure 2:
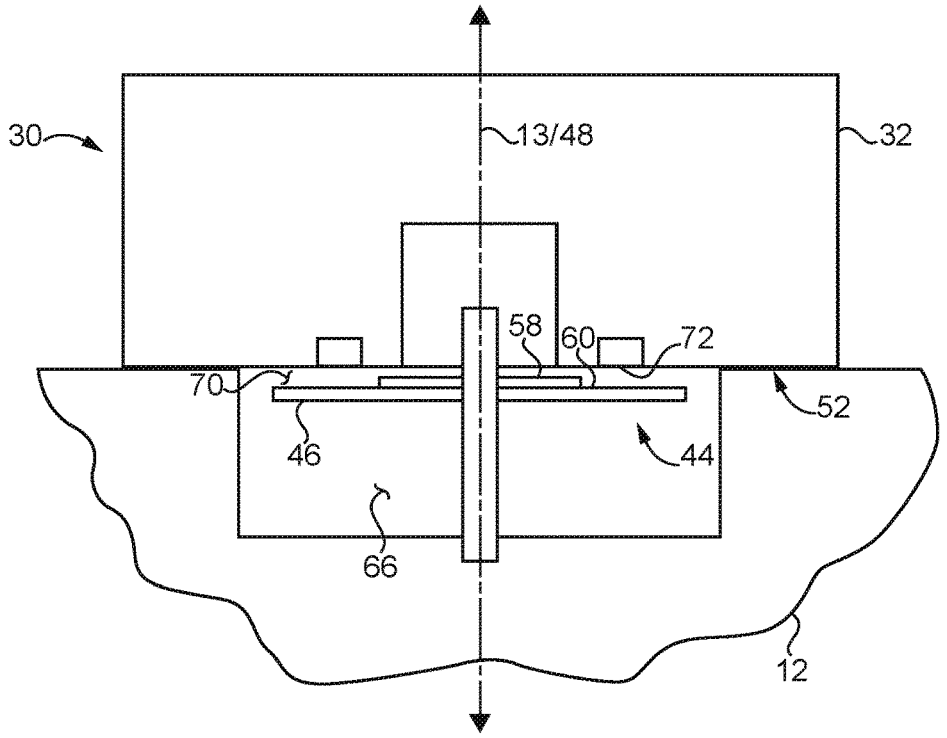
FIG. 2 is a diagrammatic illustration of portions of a valve assembly, in a first state, according to one embodiment.

Armature plate 46 includes a top armature surface 50 facing stator 32, a bottom armature surface 54, and an outer perimetric surface 56 extending circumferentially around armature center axis 48 and axially between top armature surface 50 and bottom armature surface 54. Referring FIG. 2, illustrating aspects and elements of electrical actuator 30 diagrammatically, top armature surface 50 has an inwardly stepped-up profile that forms a raised surface 58 at a radially inward location that is adjacent to stator 32 at the activated position, and a lower, gap-forming surface 60 at a radially outward location that forms a gap 70 between armature 44 and stator 32 at the activated position. Inwardly stepped-up means an increase in elevation that is relatively abrupt in a direction radially inward toward armature center axis 48, although the "step" need not necessarily be sharp or angular. A continuous change in elevation would not likely be fairly understood as inwardly stepped-up, for example.

Figure 3:
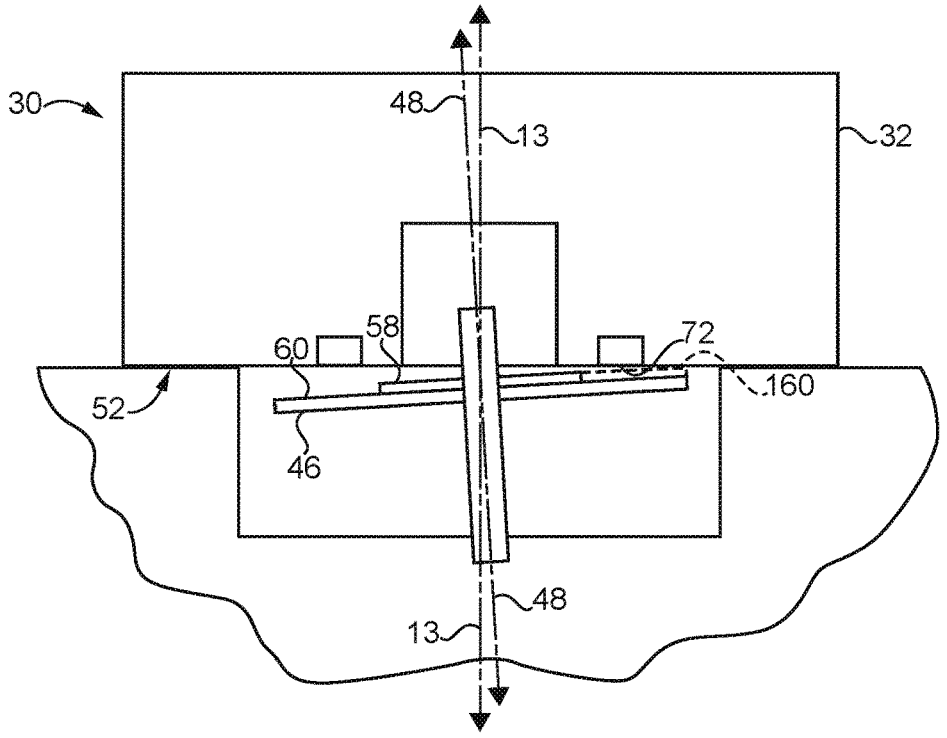
FIG. 3 is a diagrammatic view of the valve assembly of FIG. 2, in a second state.

Referring also to FIG. 3, there are shown aspects and elements of electrical actuator 30 as they might appear where armature 44 is at the activated position. At the activated position, in some instances, the armature center axis 48 may be tilted relative to pump housing longitudinal axis 13, and, in such case, top armature surface 50 is tilted relative to stator 32.

In the illustrated embodiment, an armature cavity 66 is formed in pump housing 12 to accommodate the motion of armature 44. During operation of the pump 10, the armature cavity 66 will typically be filled with the working fluid transitioned through pump 10, although of course other fluids could be used. When armature 44 is moved from its rest position, approximately as depicted in FIG. 2, to its activated position approximately as depicted in FIG. 3, fluid between stator 32 and armature 44 will be displaced. In particular, as armature 44 is moved to its activated position fluid is squeezed between top surface 50 and stator face 52. It can further be noted that a slot 72 is shown in stator 32, and in the illustrated embodiment slot 72 extends inwardly from stator face 52. Slot 72 may have an annular shape, concentric with outer stator portion 34 and inner stator portion 35, and generally centered on pump housing longitudinal axis 13.

It has been observed that the squeezing of fluid between armature 44 and stator 32, and particularly between armature 44 and slot 72, can result in a velocity and energy of the fluid that is sufficient, at least over time, to erode or otherwise damage over-molding 40. The inwardly stepped-up profile of top surface 50 ameliorates these erosive phenomena by providing an easier escape route for the displaced fluid. As noted above, top surface 50 includes raised surface 58 and lower surface 60. In earlier designs lacking an inwardly stepped-up profile no such escape route for fluid was provided. In FIG. 3, a phantom line illustrates an example armature profile 160 that can be found in certain known armature designs.

It will be recalled that moving armature 44 to the activated position can include tilting armature 44, ultimately such that a top surface 50 of armature 44 is tilted relative to stator face 52. It is believed that the tilting of armature 44, and some similar armatures, can cause or compound the phenomena potentially leading to erosion as described herein. It can be seen that the known armature profile 160 could result in armature plate 46 contacting stator 32 or nearly contacting stator 32 and limiting or preventing entirely a radially outward flow of fluid, at least in the vicinity of the point(s) of contact or near-contact between armature 44 and stator face 52, when armature 44 reaches the activated position. As a result, fluid being displaced could be expected to be redirected inwardly, circumferentially, and upwardly into slot 72, in the process being accelerated to the point that a jet(s) of high velocity fluid can damage the relatively soft over-molding 40.

Figure 4:
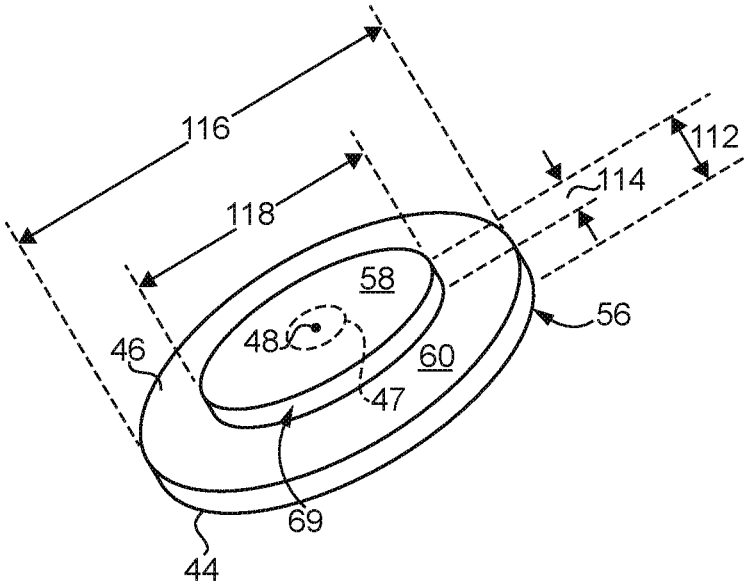
FIG. 4 is a perspective view of an armature for an electrical actuator, according to one embodiment.

Turning now to FIG. 4, there is shown armature 44 including armature plate 46 in a perspective view and illustrating additional detail. It can be seen that raised surface 58 is generally planar and circular, and an annular step surface or outer perimetric surface 69 extends between raised surface 58 and lower surface 60. Lower surface 60 is also generally planar and annular. Raised surface 58 and lower surface 60 each extend circumferentially around armature center axis 48, and will be understood also to extend circumferentially around armature pin 47. It will further be noted from FIG. 4 that the inwardly stepped-up profile of top armature surface 50 is left-right symmetric about armature center axis 48. In an implementation, the inwardly stepped-up profile includes a profile of rotation that is circumferentially uniform about armature center axis 48, and each of raised surface 58 and lower surface 60 defines a circular perimeter, with the circular perimeters being concentric. Armature plate 46 has a first axial thickness 112 within raised surface 58 and a second axial thickness 114 within lower surface 60. First axial thickness 112 may be about twice second axial thickness 114, or less. Outer perimetric surface 56 defines a first outer diameter dimension 116, and raised surface 58 defines a second outer diameter dimension 118. First outer diameter dimension 116 may be about twice second diameter dimension 118, or greater.

Magnetic flux density tends to weaken nonlinearly in directions radially outward from the center of a solenoid coil. For this reason, removing or limiting the use of material that is relatively more radially outward in an armature according to the present disclosure tends to have only a relatively mild effect, if any, on the magnitude of electromagnetic force applied to armature 44 when electrical actuator 30 is energized. It will be appreciated that various modifications to the geometry, proportions, and relative dimensions of armature plate 46 as depicted in FIG. 4 might be made without departing from the scope of the present disclosure. It is contemplated that a practical implementation includes forming armature plate 46 such that gap 70 will be in fluid communication with slot 72 when armature 44 is at the activated position. Accordingly, outer perimetric surface 69 can be positioned/sized slightly smaller than an outer diameter of slot 72, although the present disclosure is not thereby limited.

In the illustrated embodiment, electrical actuator 30 includes a solenoid electrical actuator having a winding 38 that is positioned within or at least partially within channel 36. Winding 38 includes electrically conductive metallic material in a generally conventional manner. Electrical actuator 30 may also include a non-metallic over-molding 40 encasing winding 38. An electrical plug 42 is coupled with pump housing 12 to provide for electrical connections with winding 38.

Stator 32 also includes a stator end face 52 ("stator face 52") that faces armature 44 and is formed in part by annular end faces (not numbered) of each of outer stator portion 34 and inner stator portion 35 that are positioned in a common plane, and also in part, in embodiments, by winding 38. Over-molding 40 thus forms an exposed portion of stator face 52, the significance of which will be apparent from the following description.

In order to reduce or eliminate tilting of the armature 44 including armature plate 46 and thus further reduce or eliminate wear along the lower surface of the insulation 40 surrounding the windings 38, an alternate embodiment of the electrical actuator 130 depicted in FIGS. 6-11 may be used. The electrical actuator 130 may be similar to the actuator 30 depicted in FIGS. 1-3 and 5 and identical elements in actuator 30 and actuator 130 may be identified by identical reference numbers. The electrical actuator 130 includes a generally cylindrical stator 132, a winding and terminal assembly 187 disposed at least partially within the stator, a non-magnetic barrier 190 associated with the stator, and an over-molded body 192 disposed at least partially around the stator, the winding and terminal assembly, and the barrier. An electrical connector 42 that extends from the over-molded body 192.

Figure 6:
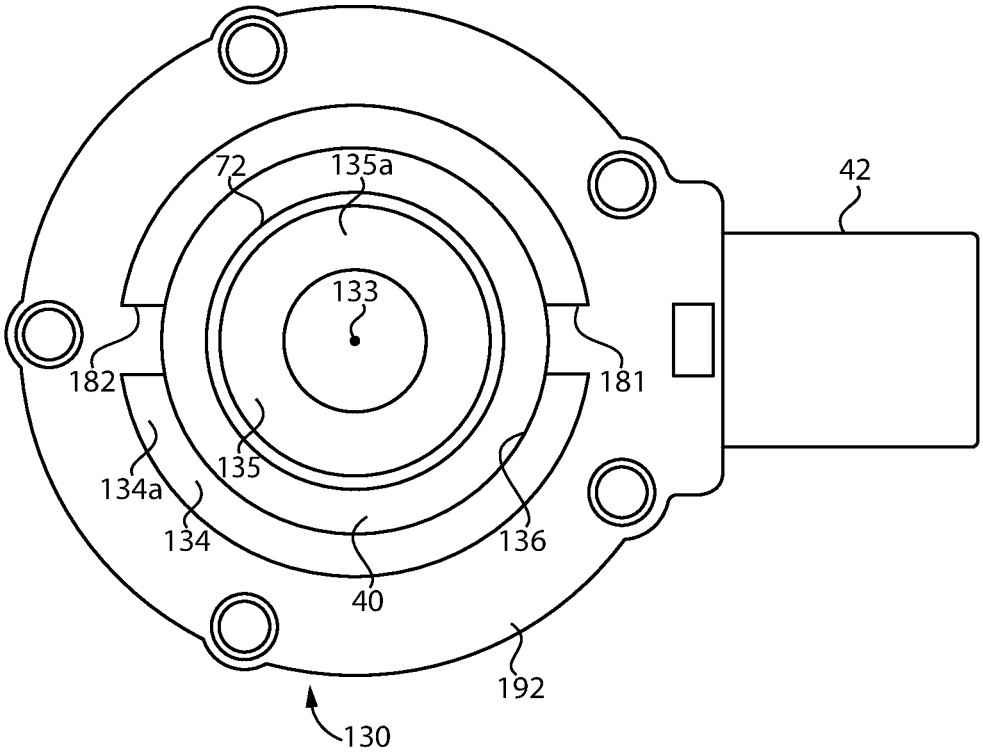
FIG. 6 is a bottom view of an alternate embodiment of an electrical actuator.
Figure 7:
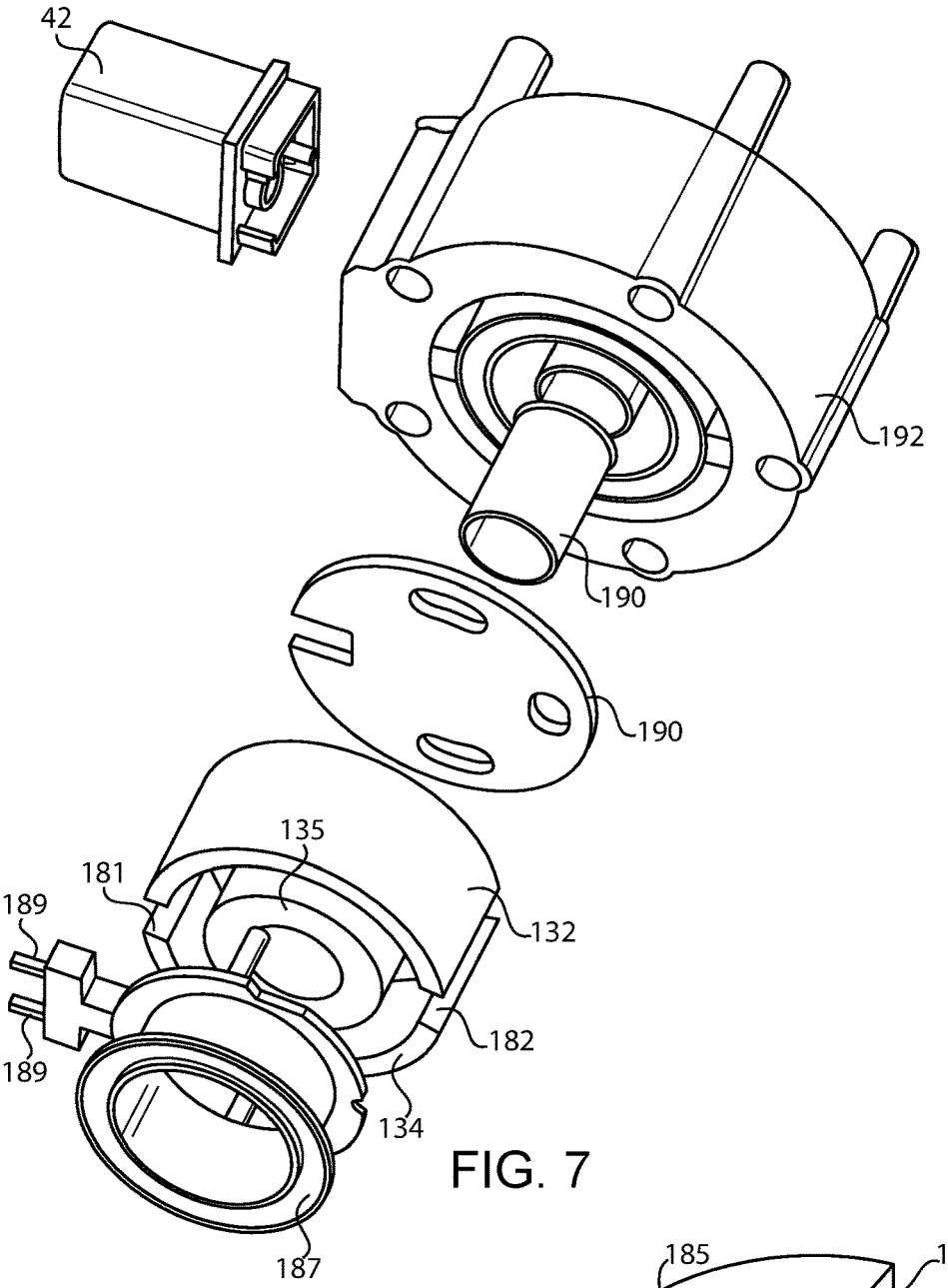
FIG. 7 is an exploded perspective view of the actuator of FIG. 6.
Figure 8:
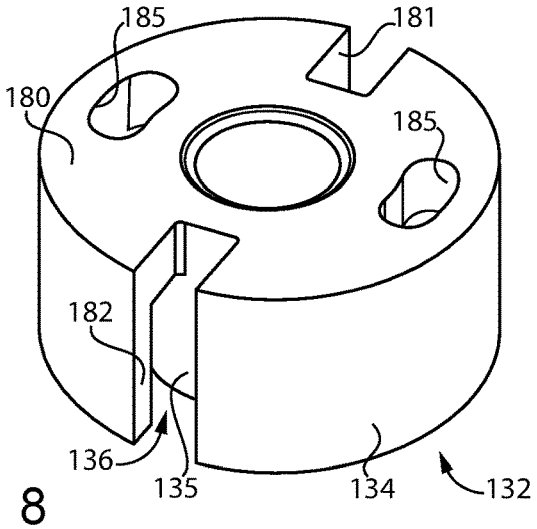
FIG. 8 is a perspective view of the stator of the actuator of FIG. 6.
Figure 9:
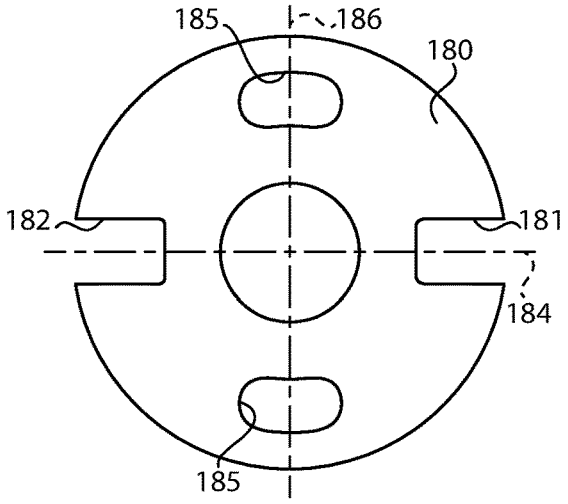
FIG. 9 is a top view of the stator of FIG. 8.
Figure 10:
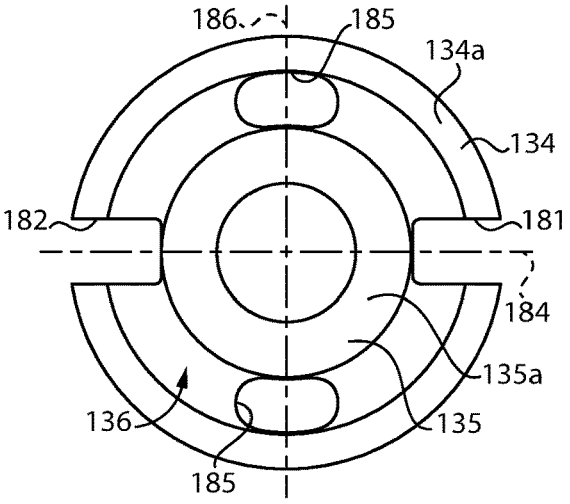
FIG. 10 is a bottom view of the stator of FIG. 8.
Figure 11:
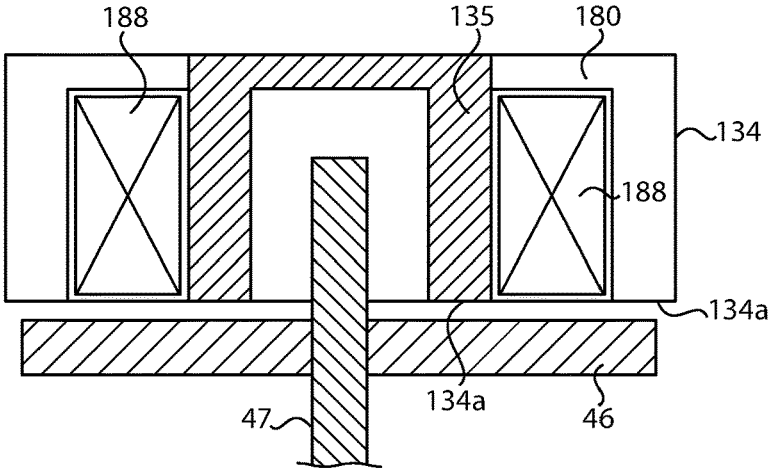
FIG. 11 is a schematic cross-sectional view of the stator of FIG. 8, windings and a portion of an armature interacting with the stator and windings.

Referring first to FIGS. 6-7, the outer profile or appearance of the actuator 130 stator may be identical or substantially identical to the actuator 30 described above. The stator 132 includes an outer stator portion 134 having an annular shape, and an inner stator portion 135 also having an annular shape. Outer stator portion 134 and inner stator portion 135 can be concentrically arranged with one another along a center axis 133 of the stator, which is also centered on pump housing longitudinal axis 13; however, the present disclosure is not thereby limited. An annular channel 136 is formed between outer stator portion 134 and inner stator portion 135. The stator 132 may include an annular upper portion 180 that interconnects the outer stator portion 134 to the inner stator portion 135. Referring to FIG. 10, the outer stator portion 134 includes an outer stator end face or lower surface 134*a* and the inner stator portion 135 includes an inner stator end face or lower surface 135*a*. Referring to FIG. 11, in an embodiment, the outer stator end face 134*a* and the inner stator end face 135*a* may be co-planar (i.e., lie in a common plane). Inner stator portion 135 may include a central opening to receive a portion of the armature pin 47 and the armature spring 68 therein as depicted in FIG. 1.

A first radial channel 181 extends through the outer stator portion 134 from the annular channel 136 to the outer surface 137 of the outer stator portion. The first radial channel 181 may also extend upwards through the upper portion 180. The first radial channel 181 provides a passage for a portion of the winding and terminal assembly 187 to pass through, as described below.

A second radial channel 182 extends through the outer stator portion 134 from the annular channel 136 to the outer surface 137 of the outer stator portion. The second radial channel 182 may also extend upwards through the upper portion 180. In an embodiment, the second radial channel may be identical to the first radial channel 181. Further, the second radial channel 182 may be disposed diametrically opposite the first radial channel 181. In other words, the first and second radial channels 181, 182 are on opposite sides of the stator central axis 133 and aligned along a line 184 that bisects the centers of both channels and also crosses through or intersects with and is perpendicular to the central axis.

In an embodiment, the upper portion 180 of the stator 132 may include openings 185 configured to assist in the assembly of the actuator 130. In some embodiments, the openings 185 may be diametrically opposed and lie along a line 186 perpendicular to line 184. In such case, the stator 132 is symmetrical about the bisecting line 184 through the first and second radial channels 181, 182. In other embodiments, the openings 185 may be slightly offset from the line 186. In such case, the lower surface of the stator 132 is symmetrical about the bisecting line 184 through the first and second radial channels 181, 182. In other embodiments, the openings 185 may be omitted. Stator 132 may be formed of any desired magnetic material, such as one having a high magnetic permeability. In one embodiment, the stator 132 may be formed of a soft magnetic composite material and be formed using a powdered metallurgy or molding process. Other materials and processes for forming stator 132 are contemplated.

The winding and terminal assembly 187 includes a bobbin 188 about which coil 38 (FIG. 1) is wound. An insulator 40 surrounds the windings 38 and may be formed by over-molding the windings and bobbin 188. Electrical terminals 189 are electrically connected to the windings 38. Once assembled, the winding and terminal assembly 187 is inserted into the annular channel 136 between the outer stator portion 134 and the inner stator portion 135 with a portion of the windings 38, insulator 40, bobbin 188, and/or terminals 189 extending through the first radial channel 181. The bobbin 188 may be formed of any desired material. In one embodiment, the bobbin 188 may be molded of polyphenylene sulfide and the terminals 189 may be machined or formed of a brass or copper alloy. Other materials and manufacturing processes are contemplated.

A non-magnetic barrier 190 may be provided between the stator 132 and the armature spring 68 to form a magnetic barrier and prevent the spring from being attracted to the stator and causing wear. The barrier 190 may be formed of any desired material. In one embodiment, the barrier 190 may be formed of stainless steel and may be formed of multiple components that may be machined, stamped, and/or extruded. Other materials and manufacturing processes are contemplated.

Over-molded body 192 may be formed about the stator 132, the winding and terminal assembly 190, and the non-magnetic barrier 190. The body 192 is similar to that depicted in FIGS. 1 and 5 except that over-molded material extends between both of the first and second radial channels 181, 182 as depicted in FIG. 6. The over-molded body 192 may be formed of any desired material. In one embodiment, the over-molded body 192 may be formed of a thermoset epoxy resin. Other materials are contemplated.

After the over-molded body 192 is formed about the stator 132, the winding and terminal assembly 190, and the non-magnetic barrier 190, the connector 42 may be secured to the body 192 with the terminals 189 extending into a cavity in the connector.

Referring to FIGS. 10-11, as a result of the symmetry of the stator 132, and particularly along the lower surface of the stator, the magnetic flux generated during actuation of the electrical actuator 130 will be uniform and thus attract the armature plate 46 in a uniform manner. Such uniform attraction or magnetic symmetry may eliminate or reduce the likelihood of the armature plate 46 skewing or tilting and causing erosion of the insulation 140 surrounding the winding 138 as the fluid is forced from between the lower surface of the stator 132 and the armature plate 46.

Figure 12:
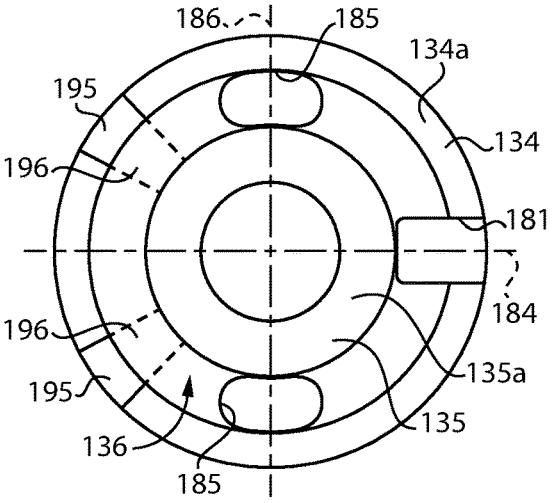
FIG. 12 is a bottom view of an alternate embodiment of a stator for use with the actuator of FIG. 7.

Other manners of achieving magnetic symmetry of the stator 132, and particularly along the lower surface of the stator 132, are contemplated. For example, rather than positioning the second radial channel 182 along the line 184, the second radial channel may be replaced by other openings in the stator to reduce the magnetic flux by an amount equal to or substantially equal to the reduction caused by the existence of the first radial channel 181. In an example depicted in FIG. 12, the second radial channel disposed along the line 184 may be omitted and replaced by a pair of additional openings 195 in the outer stator portion 134 that are disposed equidistant from the line 184. The openings 195 may be configured as radial channels or slots and extend fully or partially through the outer stator portion 134. The openings 195 may extend upward from the lower surface of the stator and, if desired, may extend through the upper portion or surface 180 of the stator 132 as depicted at the openings 196 between the dotted lines.

The positions and dimensions of the openings 195 may be adjusted to balance the magnetic flux on opposite sides of the lines 184 and 185. In an example, each pair of openings 195 and 196 may be configured as radial channels that are identical to the first radial channel 181. In such case, each of the first radial channel 181 and the pair of radial channels may be disposed circumferentially 120 degrees apart along the outer surface of the stator 132 in order to achieve magnetic symmetry of the stator.

Regardless of the shape and position of the openings 195 and 196, the over-molding material used to form the body 192 will fill the openings.

It will be appreciated by one skilled in the art that since the openings 185 are in the upper portion 180 of the stator 132, the impact on the magnetic flux relative to the armature plate 46 as a result of any asymmetry caused by the openings 185 will be reduced.

The actuator 130 may be used with an armature plate having a top surface with any desired configuration. In one embodiment, the top surface 50 may be stepped as depicted in FIGS. 1-4. In another embodiment (not shown), the top surface may be flat. In still another embodiment (not shown), the top surface may be curved.

INDUSTRIAL APPLICABILITY

Referring to the drawings generally, operating valve assembly 24 can include changing an energy state of electrical actuator 30 as discussed herein, and moving armature 44 from the rest position toward stator 32 in response to the change to the energy state of electrical actuator 30. Armature 44 will move toward the activated position and be stopped at the activated position, such as by contacting valve member 26 with valve seat 28, although depending upon manufacturing tolerances, component wear, and the degree of tilting of armature 44, raised surface 58 could also contact stator face 52. At the activated position, lower surface 60 forms gap 70 such that fluid can be displaced from between armature 44 and stator 32 by way of gap 70. Valve 26 is moved in the manner described herein to vary fluid connections to pumping chamber or plunger cavity 16 in pump 10. When electrical actuator 30 is deenergized, armature 44 can move back toward the rest position under the influence of return spring 68.

Figure 5:
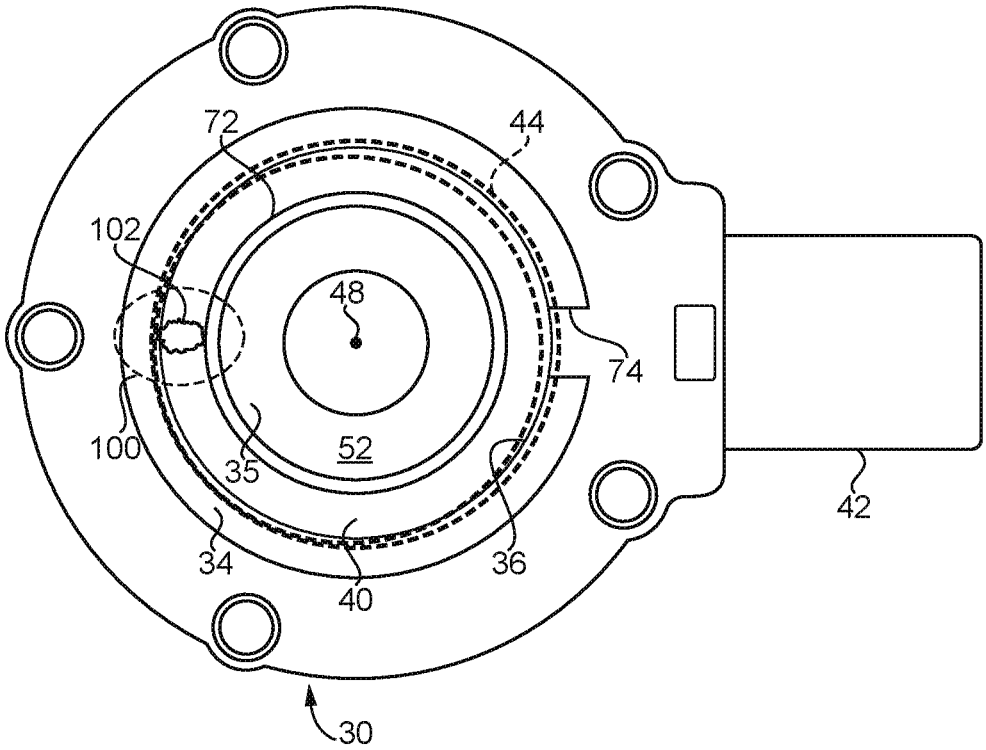
FIG. 5 is a bottom view of an electrical actuator including a stator, and an armature shown in phantom lines, according to one embodiment.

Referring now to FIG. 5 there is shown a bottom view of electrical actuator 30 as it might appear where armature 44 is shown in phantom lines. It can be seen that armature 44 is tilted, generally to the left, away from plug 42 and away from a space 74 formed by a gap in outer stator portion 34. A circle 100 is shown about an area where contact between armature 44 and stator face 52 might be observed in a known design. Also shown is a location 102 where erosive or other damage could occur, but for the profile of armature 44 as described herein. It can be further noted that location 102 is within slot 72. In other pump and/or electrical actuator designs, different erosive phenomena could be observed.

During operation of the actuator 130 of FIG. 6, the stator 132 generates a uniform magnetic field and thus the armature plate 46 is attracted to the stator in a uniform manner. Such uniform attraction reduces the likelihood that the armature plate will skew or tilt. By avoiding tilting of the armature plate 46, high velocity fluid flow between the armature plate 46 and the stator 132 may be avoided.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawing and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A valve assembly comprising:

a valve member operatively associated with a valve seat, the valve member being movable along a central axis between a first open position at which the valve member is spaced from the valve seat and a second closed position at which the valve member engages the valve seat to seal an opening of the valve assembly;

an electrical actuator including a stator, and an armature coupled to the valve member;

the stator includes an annular outer stator portion and an annular inner stator portion, and an annular channel formed radially between the outer stator portion and the inner stator portion, a first radial channel extending through the annular outer stator portion between an outer surface of the outer stator portion and the annular channel, and at least one second opening disposed in the annular outer stator portion on an opposite half of the stator from the first radial channel, the stator being magnetically symmetrical along a line bisecting the first radial channel and perpendicular to the central axis;

a winding and terminal assembly, the winding and terminal assembly comprises an electrically conductive winding disposed within the annular channel and between the outer stator portion and the inner stator portion and electrically conductive terminals electrically connected to the winding, a portion of the winding and terminal assembly extending through the first radial channel; and the armature including an armature plate defining an armature center axis, the armature center axis being co-linear with the central axis and being movable between a rest position and an activated position to vary a position of the valve member, in response to a change to an energy state of the electrical actuator, the armature plate including a top armature surface facing the stator.

2. The valve assembly of claim 1, wherein the at least one second opening comprises a second radial channel extending through the annular outer stator portion between the outer surface of the outer stator portion and the annular channel, the second radial channel being diametrically opposite the first radial channel.

3. The valve assembly of claim 1, further including an insulative over-molding encasing the winding and disposed in the annular channel.

4. The valve assembly of claim 1, wherein the outer stator portion includes an outer stator end face and the inner stator portion includes an inner stator end face, and the outer stator end face and the inner stator end face lie in a common plane.

5. The valve assembly of claim 1, wherein the winding and terminal assembly further includes a bobbin assembly around which the windings are wrapped.

6. The valve assembly of claim 1, wherein the at least one second opening comprises a second radial channel extending through the annular outer stator portion between the outer surface of the outer stator portion and the annular channel, the second radial channel being aligned with the first radial channel and on opposite sides of the central axis.

7. The valve assembly of claim 1, wherein the stator has an upper surface and a lower surface, the lower surface being disposed closer to the armature plate than the upper surface, and the lower surface of the stator is diametrically symmetrical.

8. The valve assembly of claim 1, wherein the stator has an upper surface and a lower surface, the lower surface being disposed closer to the armature plate than the upper surface, and the lower surface is symmetrical about a bisecting line through the first radial channel and intersecting with and perpendicular to the central axis.

9. The valve assembly of claim 8, wherein the outer surface of the outer stator portion is symmetrical about the bisecting line.

10. The valve assembly of claim 8, wherein the stator is symmetrical about the bisecting line.

11. The valve assembly of claim 1, further comprising an over-molded body that extends about the stator and into each of the first and second radial channels.

12. A valve assembly comprising:

a valve member operatively associated with a valve seat, the valve member being movable along a central axis between a first open position at which the valve member is spaced from the valve seat and a second closed position at which the valve member engages the valve seat to seal an opening of the valve assembly;

an electrical actuator including a stator, and an armature coupled to the valve member;

the stator includes an annular outer stator portion and an annular inner stator portion, and an annular channel formed radially between the outer stator portion and the inner stator portion, a first radial channel extending through the annular outer stator portion between an outer surface of the outer stator portion and the annular channel, and at least one second opening disposed in the annular outer stator portion on an opposite half of the stator from the first radial channel, the stator being magnetically symmetrical along a line bisecting the first radial channel and perpendicular to the central axis;

a winding and terminal assembly, the winding and terminal assembly comprises an electrically conductive winding disposed within the annular channel and between the outer stator portion and the inner stator portion and electrically conductive terminals electrically connected to the winding, a portion of the winding and terminal assembly extending through the first radial channel;

an over-molded body that extends about the stator and into each of the first radial channel and the at least one second opening; and the armature including an armature plate defining an armature center axis, the armature center axis being co-linear with the central axis and being movable between a rest position and an activated position to vary a position of the valve member, in response to a change to an energy state of the electrical actuator, the armature plate including a top armature surface facing the stator.

13. The valve assembly of claim 1, further including an insulative over-molding encasing the winding and disposed in the annular channel.

14. The valve assembly of claim 12, wherein the stator has an upper surface and a lower surface, the lower surface being disposed closer to the armature plate than the upper surface, and the lower surface of the stator is diametrically symmetrical.

15. The valve assembly of claim 12, wherein the stator has an upper surface and a lower surface, the lower surface being disposed closer to the armature plate than the upper surface, and the lower surface is symmetrical about a bisecting line through the first and second radial channels and intersecting with the central axis.

16. The valve assembly of claim 15, wherein the outer surface of the outer stator portion is symmetrical about the bisecting line.

17. The valve assembly of claim 15, wherein the stator is symmetrical about the bisecting line.

18. The valve assembly of claim 1, further comprising an over-molded body that extends about the stator and into each of the first and second radial channels.

19. A pump comprising:

a pump housing;

a pumping element movable between a retracted position and an advanced position within a pumping chamber formed in the pump housing;

a valve assembly for controlling a flow of a fluid to or from the pumping chamber, the valve assembly including a valve member operatively associated with a valve seat, the valve member being movable along a central axis between a first open position at which the valve member is spaced from the valve seat and a second closed position at which the valve member engages the valve seat to seal an opening of the valve assembly;

an electrical actuator including a stator, and an armature coupled to the valve member;

the stator includes an annular outer stator portion and an annular inner stator portion, and an annular channel formed radially between the outer stator portion and the inner stator portion, a first radial channel extending through the annular outer stator portion between an outer surface of the outer stator portion and the annular channel, and at least one second opening disposed in the annular outer stator portion on an opposite half of the stator from the first radial channel, the stator being magnetically symmetrical along a line bisecting the first radial channel and perpendicular to the central axis;

a winding and terminal assembly, the winding and terminal assembly comprises an electrically conductive winding disposed within the annular channel and between the outer stator portion and the inner stator portion and electrically conductive terminals electrically connected to the winding, a portion of the winding and terminal assembly extending through the first slot;

the armature including an armature plate defining an armature center axis, the armature center axis being co-linear with the central axis and being movable between a rest position and an activated position to vary a position of the valve member, in response to a change to an energy state of the electrical actuator, the armature plate including a top armature surface facing the stator; and an over-molded body that extends about the stator and into each of the first and second radial channels.

* * * * *